US006671887B1

(12) United States Patent
Eligan et al.

(10) Patent No.: US 6,671,887 B1
(45) Date of Patent: Jan. 6, 2004

(54) WEIGHTED ACCESSORY FOR GARMENTS

(76) Inventors: Raymond Eligan, 4427 Candlewood St., Suite 194, Lakewood, CA (US) 90712-1736; Darryl Brown, 4427 Candlewood St., Suite 194, Lakewood, CA (US) 90712-1736

( * ) Notice: Subject to any disclaimer, the term of this patent is extended or adjusted under 35 U.S.C. 154(b) by 0 days.

(21) Appl. No.: 10/302,695

(22) Filed: Nov. 25, 2002

Related U.S. Application Data

(60) Provisional application No. 60/344,736, filed on Jan. 4, 2002.

(51) Int. Cl.[7] ..... A41D 1/06
(52) U.S. Cl. ..... 2/228; 482/105
(58) Field of Search ..... 2/228, 227, 79, 2/238, 247, 248, 250, 69, 94, 102, 115, 108; 482/105, 124

(56) References Cited

U.S. PATENT DOCUMENTS 4,303,239 A * 12/1981 Walsh, Jr. ..... 482/105
4,958,386 A * 9/1990 Louis-Jeune ..... 2/227
5,010,596 A * 4/1991 Brown et al. ..... 2/228
5,033,117 A * 7/1991 Fairweather ..... 2/69
5,500,959 A * 3/1996 Yewer, Jr. ..... 602/19
5,551,084 A * 9/1996 Freese, III ..... 2/23
6,161,222 A * 12/2000 Strickland et al. ..... 2/228

* cited by examiner

*Primary Examiner*—Tejash Patel
(74) *Attorney, Agent, or Firm*—Roger A. Marrs

(57) ABSTRACT

A weighted garment having a plurality of pockets for insertably receiving and retaining weighted inserts or members, whereby the increased weight serves as resistance for exercising the wearer's limbs, torso, etc. The pockets are integral with the stretch material of the garment and a D-ring is installed on the belt of the garment for attachment with a pull or tugging cable. The pockets are reinforced and a separate arrangement of pockets may be releasably attached to the exterior surface of the garment.

3 Claims, 3 Drawing Sheets

FIG. 6
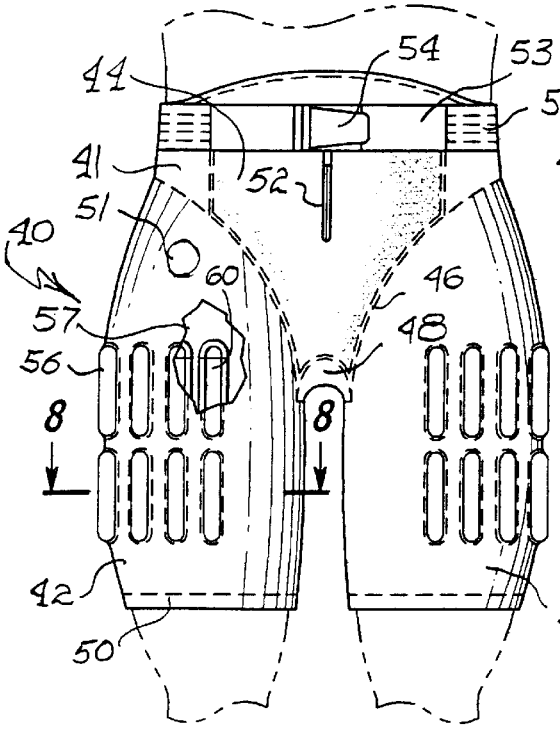
FIG. 7
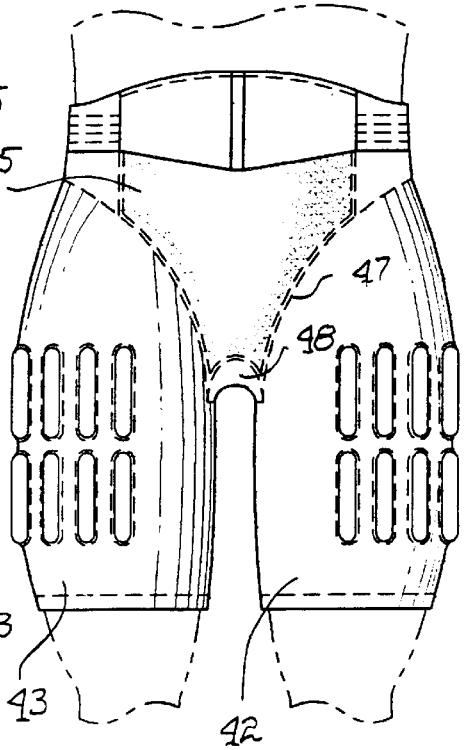
FIG. 8
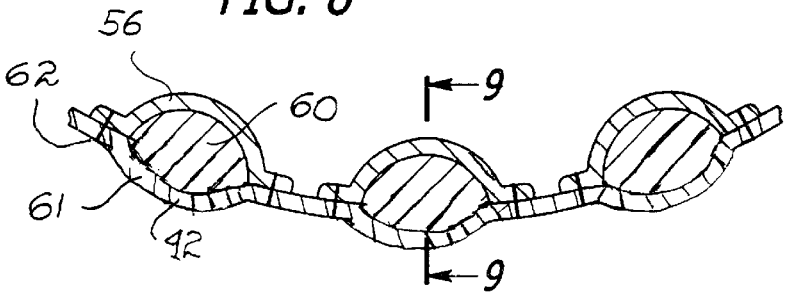
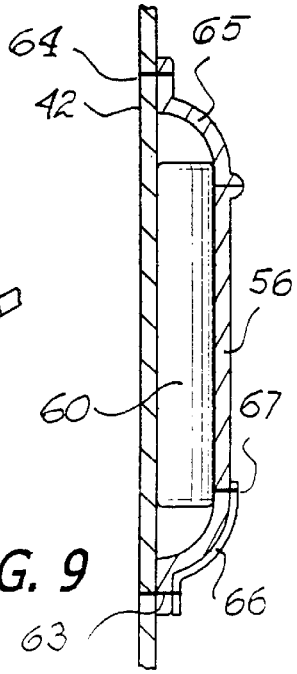
FIG. 9

68
65
42
60
62
67
66
56

53
54
73
70
74
72
41
71
75
76

84
83
82
85
81
41
90
91
87

92
80
86
88

WEIGHTED ACCESSORY FOR GARMENTS

Priority Claimed on Ser. No. 60-344,736 filed Jan. 4, 2002.

BACKGROUND OF THE INVENTION

1. Field of the Invention

The present invention relates to the field of weighted accessories for exercising purposes and, more particularly to a novel weighted accessory detachably connected to the garments of a person undergoing training exercises.

2. Brief Description of the Prior Art

In the past, it has been the conventional practice in toning or exercising muscles to employ weights which when lifted or manipulated by the user will strengthen and/or tone muscles. Some muscles are more difficult to exercise and require longer periods of exercise as well as increased weights as compared to toning and exercising other parts of the person's body. For example, the quadriceps muscles in the thighs as well as the hamstring muscles and the gluteus maximus muscles require special attention and are difficult muscles to train. Conventional exercise machines generally require that a person employ heavy bar bell weights and do what is known as squats in multiple sets in order to exercise the quadriceps. In other instances, benches are employed where the person undergoing training is prone and the legs are curled about pivoted levers to which weights are attached. Such prior devices are heavy and require a great deal of floor space. Usually a person undergoing weight training wears a gym costume of some sort but the costume is not used to carry weights during the training period. Although the costume may employ pockets, cuffs or the like, these garment conveniences are not used in connection with performing specific exercises.

Therefore, a long-standing need has existed to provide a garment worn by a person undergoing weight training which may include pockets for holding a plurality of weights so that resistance training can be achieved as a person normally walks about. The weights may be placed in detachable pockets that can be arranged on the arm or leg portions of garments worn by the person or the pockets may be formed as an integral part of the garment. The weights should be readily removable so that the choice of overall weight can be selected depending on the experience and conditioning of the user.

SUMMARY OF THE INVENTION

Accordingly, the above problems and difficulties are avoided by the present invention which provides a novel weighted accessory for use in connection with exercising garments or costumes and which are integral therewith. In one form of the invention, a garment such as a pair of shorts which are worn about the hips and thighs of the person in training includes a plurality of pockets intended to insertably receive a plurality of weights when the garment is worn by the user. The pockets may be formed on either the outside or the inside of the garment; however, it is preferred that the opening leading into the pockets be formed on the inside of the garment for aesthetic purposes. The plurality of pockets may be formed by individually stitching a sheet of material to a backing sheet of material at spaced-apart intervals so that storage cavities are provided between the stitched seams holding the first sheet to the second sheet. The weight may take the form of elongated weight members composed of steel, lead or the like and the opening to the respective storage compartments of each of the stitched pockets may be open or a flap may be employed for covering all of the openings. A snap fastener may be employed for holding the flap in a releasably closed position. In another form of the invention, the pockets may be formed as a separate piece which is detachably connected by means of a hook and pile fastener to the sleeves of an exercising garment or costume or to the outside of the shorts worn by the user. In the latter instance, the two component hook and pile fastener includes one component on the backside of the pocket accessory, while the other component is the material of the garment worn by the user.

Therefore, it is among the primary objects of the present invention to provide a series or plurality of pockets arranged in side-by-side relationship on a garment worn by a person undergoing exercise training and wherein weighted inserts are carried in the respective pockets to provide resistance as the user moves about.

Another object of the present invention is to provide a pocket or series of pockets which are carried as a single unitary construction on a garment or costume worn by persons undergoing an exercise training procedure wherein weights may be placed in their respective pockets.

Yet another object resides in providing a plurality of weights which may be slipped into respective pockets which are integrally formed on the garment of a person undergoing weight training exercises.

A further object resides in providing a weight training system whereby a plurality of weights may be carried in pockets on the garment of the user so that resistance is provided to the muscles of the user as the user moves about in normal daily activity.

Another object resides in providing a weighted garment with substantial crotch reinforcement to transmit load forces into the body of the garment and the user.

Still a further object resides in a weighted garment having reinforced waist cinching or belting including a D-Ring for attachment to a load bearing cable or rope.

Yet another object relates a weighted garment with a stretchable fabric carrying pockets for holding individual weights with an interconnecting mesh or perforated abdominal section and a reinforced crotch section.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 6 is a front elevational view of another embodiment of the invention illustrating a mesh or perforated abdominal section or panel with a reinforced crotch panel;

FIG. 7 is a rear elevational view of the embodiment shown in FIG. 6;

FIG. 8 is an enlarged fragmentary cross-sectional view of the weighted pockets as taken in the direction of arrows 8—8 of FIG. 6;

FIG. 9 is a longitudinal cross-sectional view of a weighted pocket shown in FIG. 8, as taken in the direction of arrows 9—9 thereof;

DESCRIPTION OF PREFERRED EMBODIMENT

Figure 1:
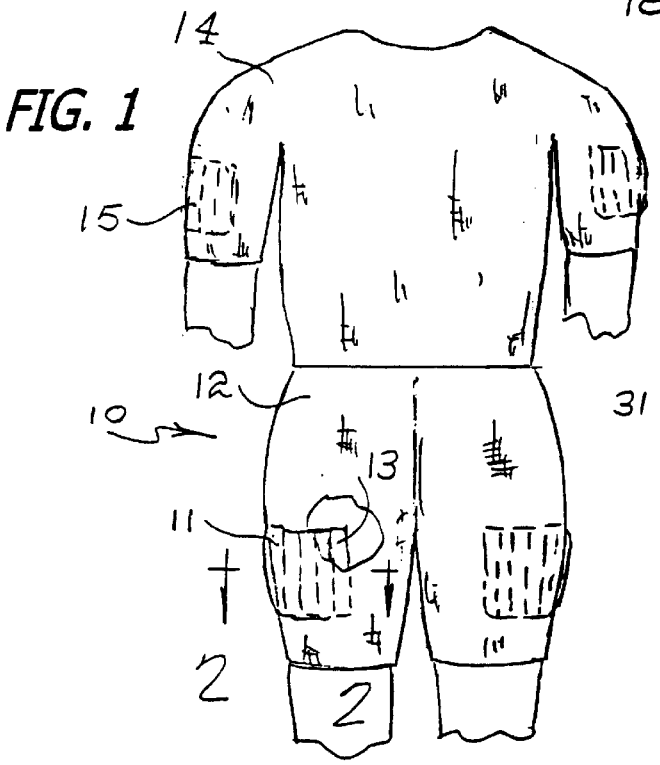
FIG. 1 is a diagrammatic view of a person wearing an exercise costume with a plurality of pockets carrying weights so that the muscles of the body are exercised as a person moves about.

Referring to FIG. 1, the inventive weighted accessory is indicated in the general direction of arrow 10 which includes a plurality of pockets, such as pocket 11, that are attached to the inside surface of a garment 12. A single pocket may be employed or a plurality, as illustrated, and it is to be understood that the pockets may be carried externally on the outside surface of the garment 12 as well as on the inside. The garment 12 represents a pair of shorts intended to be worn by a person undergoing an exercising or weight training procedure and preferably, the pocket or pockets are placed adjacent to the thigh area on the legs of the garment covering the thigh of the user. A section of the garment is broken away to illustrate the pocket or pockets in solid lines and identified by numeral 13. Preferably, the garment is composed of a stretchable material such as stretch nylon, neoprene or the like. The composition of the material for the pockets is intended to match the material of the garment 12.

FIG. 1 also illustrates that the pocket or plurality of pockets may be detachably connected to the garment of the user such as at the upper arm portion of the garment indicated by the numeral 14. The upper portion includes the sleeve and the pocket or pockets may be detachably connected to the external surface of the sleeve and is indicated by numeral 15. This embodiment of the invention will be described later in connection with FIG. 4.

Figure 2:
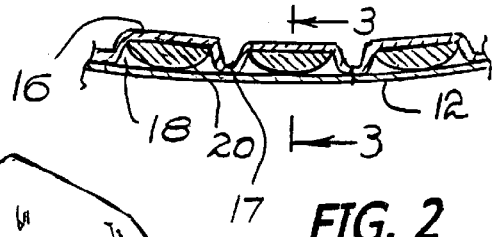
FIG. 2 is an enlarged, fragmentary cross-sectional view of the pockets including inserted weights as taken in the direction of arrows 2—2 of FIG. 1.
Figure 3:
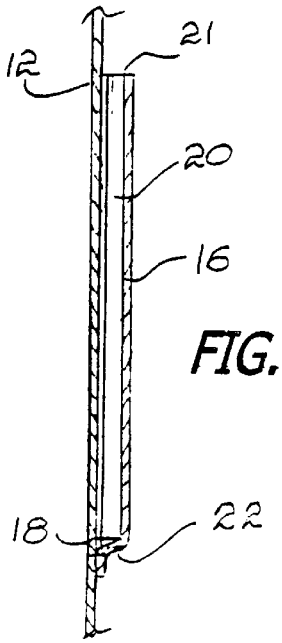
FIG. 3 is a transverse, cross-sectional view of the pocket and weight as taken in the direction of arrows 3—3 of FIG. 2.

The pocket or pockets 11 are integrally formed with the garment 12 and as shown in FIGS. 2 and 3, the garment 12 forms a first sheet of material and the pocket or pockets is formed by a second sheet indicated by numeral 16 which is stitched to the first sheet at spaced-apart intervals. Such a stitching is indicated by numeral 17 in FIG. 2 and sufficient space is provided between the sheets 12 and 16 to provide a storage compartment as indicated by numeral 18. Each of the respective storage compartments is occupied by a weight 20 that can be composed of lead or iron and weight 20 is illustrated as occupying storage space 18.

As indicated in FIG. 3, the top of each of the respective pockets may be open, as indicated by numeral 21, while the bottom of the compartment is closed by stitching shown by numeral 22. The weight 20 occupies the storage compartment and has been inserted through the opening 21 and extends to the bottom stitching 22 of the pocket. A single pocket may be employed for holding a flat rectangular weight, or as illustrated, a plurality of pockets are provided for insertably receiving a plurality of weights in the storage compartment of each pocket.

Figure 4:
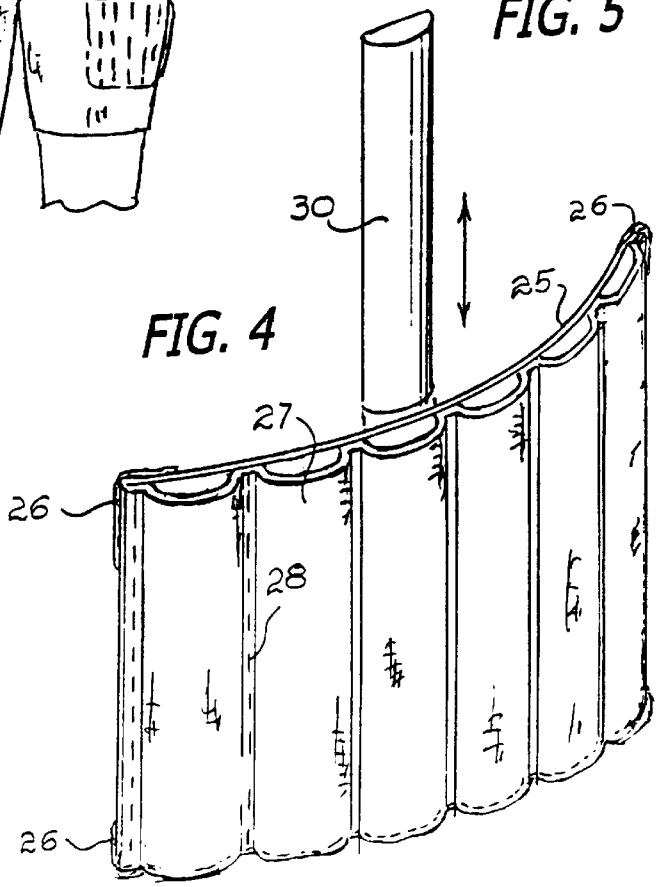
FIG. 4 is an exploded perspective view showing a plurality of pockets formed as a separate accessory for detachably connecting to the garment of the user.

Referring to FIG. 4, a similar arrangement of pockets to that indicated by numeral 11 is provided in the general direction of arrow 15 as previously explained. The plurality of pockets are detachably connected to the external surface of the garment either about the leg area of the user or the arm sleeve area. In either event, a first sheet of material 25 is employed as a backing sheet on which a plurality of hook and pile fastener components are carried. For example, a hook component is indicated by numeral 26 as arranged on each corner of the backing sheet 25. However, the material of the garment represents the opposite fastening component such as the pile portion thereof. The plurality of pockets are formed by a second sheet 27 and are defined between parallel arranged stitching 28 separating each of the pockets. Other means may be employed for securing the second sheet to the first sheet such as by employing proper adhesive, thermal bonding or the like. In the embodiment shown in FIG. 4, the top of each pocket is open so as to insertably receive a length of weighted material indicated by numeral 30. The weight may be composed of lead or iron and may be plastic coated if desired. The weight 30 may be the same weight as weight 20 and the open top may include a tab or cover.

Figure 5:
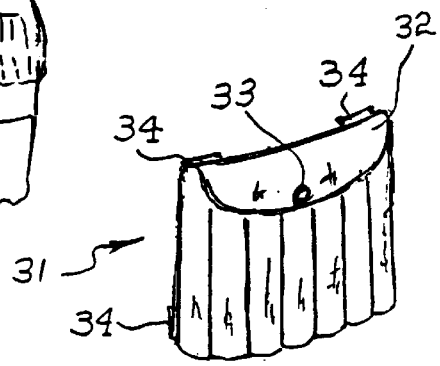
FIG. 5 is a reduced front perspective view of the weighted pocket accessory incorporating the present invention and including a flap for closing the opening leading into storage compartments of the respective pockets.

In FIG. 5, a detachable set of pockets similar to that shown in FIG. 4 is indicated by numeral 31 and it can be seen that a hinged flap 32 is employed for covering the respective openings leading into the storage compartment of the plurality of pockets. A fastener of the snap-type is indicated by numeral 33 and may be used as a means for securing the flap. As described with respect to the pocket 15, the backside of the pocket 31 may include a component for attaching to the garment 12 or 14 and are indicated in general by the numerals 34.

In view of the foregoing, it can be seen that the weighted pockets of the present invention may be incorporated integrally with the garment, whether the garment be a shirt 14 having sleeves or a pair of pants or shorts 12. It is preferred that the pocket of weights be placed at critical or strategic locations with respect to the user's body so that maximum workout of the muscles in the adjacent area can be achieved. The muscles are exercised and toned as the person moves about either in accordance with a prescribed training procedure or during normal daily activities. As muscle development occurs, the user has the option of increasing the weights by removing the previously used weights and substituting weights of heavier density. In order to reduce the size of the weights and therefore the pockets as well, it is preferred that a high density weight material be employed so as to reduce overall dimensions. The size and shape of each of the weights is matched with the size and weight of the respective pockets. The material of the pockets is stretchable so that weights of different size can be accommodated.

Referring now in detail to FIGS. 6 and 7, another embodiment of the present invention is illustrated in the general direction of arrow 40 which includes a garment taking the form of a pair of shorts 41 having a leg section 42 and another leg section 43, which are joined together by an abdominal section 44. The abdominal section 44 is in the front of the garment while a posterior section 45 connects the leg sections 42 and 43 at the rear of the garment. It is to be particularly noted that the front panel 44 and rear panel 45 are composed of a mesh or open fabric material, so that "breathing" can occur for the protection of underlying skin and to permit heat to escape. The leg sections are attached to the front and rear panels by stitching, such as indicated by numerals 46 and by numeral 47. It is also to be noted that the crotch of the garment, as indicated by numeral 48, is reinforced by a double thickness panel so that stresses encountered with the weighted leg sections 42 and 43 will not tear or rip this portion of the garment. Stresses and load factors encountered by the leg sections and crotch panel 48 are distributed through the garment to the body of the user.

Stitching, indicated by numeral 50, is provided along the bottom of the leg sections 42 and 43 to provide for turning the edge of the sections over upon themselves so that securement can be made by the stitch line. Also, a special area, indicated by numeral 51, is employed for applying labels, indicia or other matter pertaining to graphic representations, alpha-numeric information or pictorial subject matter. The garment may include a zipper or hook and pile closure 52 whereby the user may conveniently get into the pair of shorts 40 or get out of the shorts. For adequate retention of the pair of shorts on the user, a belt 53 is positioned around the waist of the garment and a suitable closure, such as a hasp 54, may be employed. A portion of the belt 53 may be elastic, as indicated by numeral 55.

It is to be noted that each of the leg sections 42 and 43 includes a plurality of pockets 56 that may be arranged in rows and columns, either on the outside or inside of the garment. Preferably, the pockets are placed on the inside surface of the garment and such a pocket is exposed through opening 57 to illustrate inside installation of the pocket. In FIGS. 6 and 7, it can be seen that the rows of pockets 56 extend across the front of each leg section and around the sides to the rear thereof. Each pocket receives insertion of a weighted insert as indicated by numeral 60.

Referring now in detail to FIG. 8, it can be seen that the respective weighted inserts 60 have been installed in the storage compartment of each of the respective pockets 56. A slight bulge, as indicated by numeral 61, may occur in the leg section 42 which is visibly observable from the front or outside of the garment as it is worn. It is also to be noted that a plurality of parallel stitch lines 62 are included and tack the edge marginal region of the pocket 56 to the leg section 42. The plurality of stitch lines 62 are provided on each side of each respective pocket 56.

Referring to FIG. 9, it can be seen that transverse stitch lines, as indicated by numerals 63 and 64, secure the top and bottom of each pocket to the leg section 42. Each of the respective pockets 56 includes a closed opening which is closed by a lid or flexible cap 65. Finger pressure is used to open the flexible lid or cap 65 for insertion of or removal of the weighted insert 60. The bottom of the pocket 56 is reinforced by a separate piece 66 by means of bottom stitching 63 and an augmented stitch 67. Thus, the bottom of each pocket is reinforced so as to prevent fatiguing of the material at the bottom due to rubbing or engagement with the bottom of the weighted insert 60. The bulge 61 is not necessarily shown in FIG. 9 when the inserts 60 are placed inside the respective pockets, particularly when the article is not worn at the time. The flexible material of the garment is not stretched or bulged when the weighted insert is inserted or taken from the pocket when the garment is in a relaxed condition, such as when not worn at the time by the user.

Figure 10:
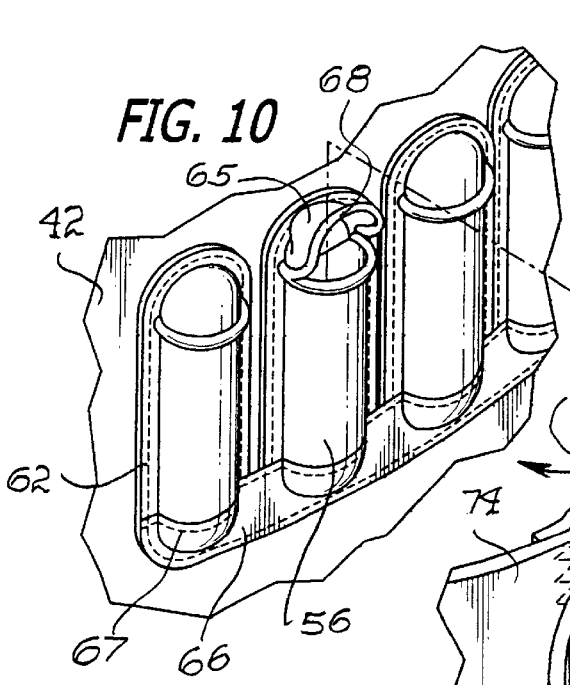
FIG. 10 is a prospective view of the weighted pockets.

Referring in detail to FIG. 10, it can be seen that the weighted insert 60 may be introduced into the storage compartment of the pocket 56 when the lid, cover or closure 65, has been flexed to its open position. Once the insert has been seated in the pocket 56, the lid or closure 65 will spring into its closed position, as illustrated by the adjacent lids or closures on adjacent pockets. Also, for convenience in opening the lid or closure, a rib 68 is formed so that the user's thumb or finger can easily cause the material to be pushed back to open the storage compartment.

Figure 11:
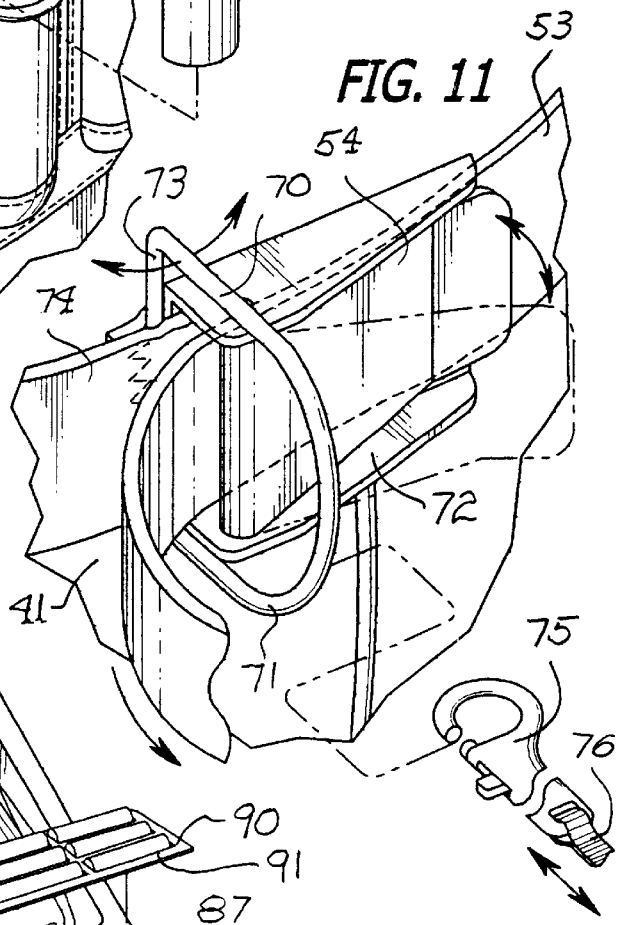
FIG. 11 is an enlarged perspective view of a weighted garment belt arrangement with D-ring attachment.

Referring now in detail to FIG. 11, a feature of the present invention is illustrated wherein a D-ring 70 is pivotally attached to the buckle of the belt 53, so that when the hasp 54 is closed, as illustrated in solid lines, the curved portion 71 of the D-ring outwardly projects ahead of the garment. The buckle arrangement includes the hasp 54, being pivotally carried on a base 72 so that as the end of the belt 53 passes between the hasp and the base, the belt can be folded over upon itself and captured in an interference fit at the pivot point of the buckle. It can be seen that the straight portion 73 of the D-ring 70 is captured by an end 74 of the belt 53, opposite from its end, coupled to the base 72. The purpose of the D-ring is to serve as a connector for a snap-ring 75 that is connected on the end of a tension cord 76, such as a cable or the like. As the cable is pulled in the direction of the double arrows, the D-ring is tensioned and the belt about the waist of the user is also tensioned. Therefore, the user can experience a pulling force which will again exercise the user's body.

Figure 12:
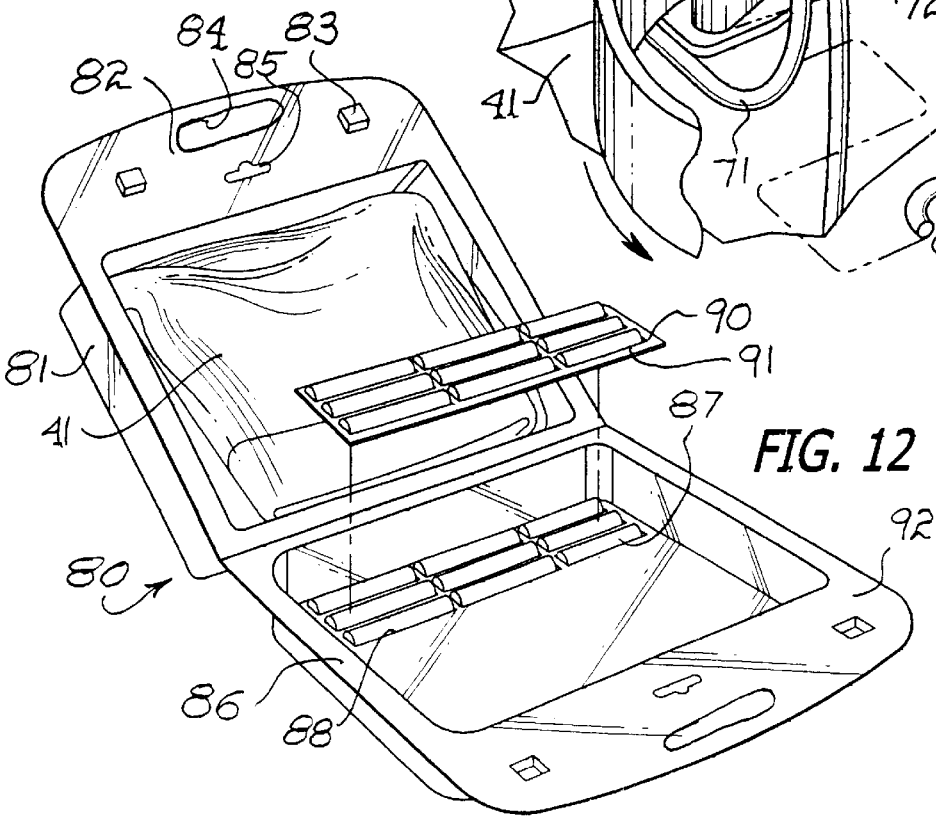
FIG. 12 is a perspective view of a storage package for a weighted garment and a supply of weights.

With respect to FIG. 12, a package for the pair of shorts 41 is illustrated, which includes a case having a box-like portion 81 in which the pair of shorts 41 are removably packed. A header 82 of the box-like container is indicated by numeral 82 and includes a component of a two-component fastener such as projected component 83. A carrying handle 84 is integrally formed into the header as well as an aperture 85 for insertably receiving a hook, pin or the like in order to hang the closed package on a rod. The other portion of the package 80 includes a container portion 86 having an interior compartment for storing a plurality of weighted inserts, such as insert 87. The inserts are typical as previously described for use in connection with insertion into the plurality of pockets on the garment 41. In the present instance, the weighted inserts 87 may be stored in formed receptacles, such as receptacle 88, formed in the bottom of the container portion 86, or a separate and removable tray 90 may be used. The tray has a plurality of storage recesses, such as recess 91, in which the weighted inserts can be partially retained. The entire tray 90 can be inserted into the cavity of the container portion 86 in addition to or independent from the storage area carried on the bottom of the container portion 86. It is also to be noted that the container portion 86 includes a header 92, which mates with and includes indexed features to coincide with the features of the header 82.

In view of the foregoing, it can be seen that the weighted garment may take different forms and include several embodiments. The weighted pair of shorts 41 places stress and strain on the wearer's muscles so that the muscles are thoroughly exercised in order to produce increased strength and tone.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A weighted garment comprising:

a pair of shorts having leg sections downwardly depending from a waistband composed of a stretchable material having an inside surface and an exterior surface;

a plurality of individual pockets carried on each of the leg sections and arranged in a side-by-side relationship on said inside surface of said garment;

each of said pockets having an open end and a closed end separated by a storage compartment;

a plurality of weighted inserts disposed in said storage compartments of said pockets;

each of said weighted inserts having a smooth exterior surface readily insertable through said open end of said pocket;

each pocket having a closure lid for selectively opening and closing said open end of each of said pockets;

reinforcement means extending along said closed end of said plurality of pockets;

said plurality of pockets arranged in rows and columns on said leg sections;

a reinforcement crotch panel interconnecting said leg sections together for transferring load forces between the leg sections;

a D-ring coupled on said waistband with a curved section extending outwardly from said waistband;

said garment includes a front section composed of a fine mesh for conducting heat from the body of the wearer.

2. The weighted garment defined in claim 1 wherein:

said plurality of pockets are located on said leg sections to be adjacent major muscle areas of the wearer.

3. The weighted garment defined in claim 2 wherein:

said pair of shorts includes a waist securement chosen from the group consisting of:

a. a cinched belt;

b. a construction belt; or c. a buckled belt.

* * * * *